US005392055A

United States Patent [19]

Madnick et al.

[11] Patent Number: 5,392,055

[45] Date of Patent: Feb. 21, 1995

[54] RADIO ANTENNA

[75] Inventors: Peter A. Madnick, Thousand Oaks, Calif.; Richard J. Kaufman, New York, N.Y.

[73] Assignee: Recoton Inc., Long Island City, N.Y.

[21] Appl. No.: 2,114

[22] Filed: Jan. 4, 1993

Related U.S. Application Data

[63] Continuation of Ser. No. 718,296, Jun. 20, 1991, abandoned, which is a continuation-in-part of Ser. No. 515,608, Apr. 27, 1990, abandoned.

[51] Int. Cl.[6] ..... H01Q 9/30

[52] U.S. Cl. ..... 343/790; 343/752; 343/825; 343/862; 343/905

[58] Field of Search ..... 343/749, 752, 790, 791, 343/792, 830, 829, 905, 825, 826, 720, 860, 862; H01Q 9/00, 9/30, 1/50

[56] References Cited

U.S. PATENT DOCUMENTS

| | | | |
|---|---|---|---|
| 2,834,961 | 5/1958 | Lear et al. | 343/705 |
| 3,521,169 | 7/1970 | Turner et al. | 343/752 |
| 4,328,501 | 5/1982 | DeSantis et al. | 343/749 |

*Primary Examiner*—Michael C. Wimer
*Attorney, Agent, or Firm*—Levisohn, Lerner & Berger

[57] ABSTRACT

A radio antenna which takes the form of a flexible elongated transmission cable. This cable encloses a pair of conductors which are insulated from each other. The cable is encased in an electrically conductive sheath. The received signal is picked up by the sheath and transmitted through an impedance matching network and into the pair of conductors. The length of the sheath is correlated to a preselected fractional value of the wavelength of the received signal.

10 Claims, 1 Drawing Sheet

RADIO ANTENNA

REFERENCE TO PRIOR APPLICATION

This application is a continuation of application Ser. No. 07/718,296, filed Jun. 20, 1991, now abandoned, which is a continuation-in-part of Ser. No. 515,608 filed Apr. 27, 1990, abandoned.

BACKGROUND OF THE INVENTION

The field of this invention relates to antennas, and more particularly to an antenna for picking up a radio signal.

An antenna is a device for transmitting or receiving radio waves. The transmitting antenna converts the electrical signals from a transmitter (radio, television or radar) into an electromagnetic wave which spreads out from the transmitter. A receiving antenna intercepts this wave and converts it back into electrical signals; that can be amplified and decoded by a receiver such as a radio, television or radar set.

A radio transmitter produces its signal in the form of an alternating electric current, that is, one which oscillates rapidly back and forth along its wire. The rate of this oscillation can be anything from tens of thousands of times a second to thousands of millions times a second. The rate is known as a frequency and is measured in kilohertz or kilocycles and for higher frequencies in MegaHertz or Megacycles.

The oscillating current in the transmitting antenna produces an electromagnetic wave around it, which spreads out from it like ripples in a pond. This wave sets up electric and magnetic fields. The lines of the electric field run along the antenna and those of the magnetic field around it. Both the electric and magnetic fields oscillate in time with the electric current.

Whenever this wave comes into contact with the receiving antenna, it induces a small electric current in the antenna. This small electric current alternates back and forth along the antenna in time with the oscillations of the wave.

The air is full of radio waves at all frequencies which the antenna picks up indiscriminately. Each radio set has a means of selecting a narrow band of frequencies at any one time. This is what happens when a particular signal is tuned in. Each radio set can be tuned within a certain frequency range and will respond to signals only in that range.

Electricity travels along a wire at a speed close to the speed of light. It will greatly increase the efficiency of an antenna if its length is correctly correlated to the wavelength of the signal it received or transmits. Ideally, antennas are normally selected to be one-half or one-quarter of the wavelength that they are designed to receive with the addition of a small amount of length to compensate for loss within the antenna itself. An AM radio signal is over one thousand feet in length. An FM radio signal is substantially shorter and is approximately one hundred eight inches in length. Therefore, within conventional radio sets, it is difficult to design an antenna which is any significant percentage in length of either AM or FM. Clearly, AM would be more difficult since the quarter wave length in AM would be over two hundred fifty feet in length. A quarter wavelength for FM would require an antenna approaching thirty inches which is still too large in size for most radio sets which would result in a rather unattractive appearance. A typical antenna for a radio set will usually take the form of some form of coil or wound wire which is mounted on some form of a stand which is placed on or near the radio set.

SUMMARY OF THE INVENTION

The primary objective of this invention is to construct an antenna that can be used for a radio receiver which picks up the receiver signal more efficiently than antennas in the prior art and which has eliminated the normally unsightly appearance of a unit being mounted on or near the radio receiver.

The antenna of the present invention is in the form of a flexible cable. This cable is to be connected to the receiver and then may be stretched in any desirable configuration and may be placed in an out-of-the-way location such as behind a cabinet, along a floor baseboard in a home, etc. This cable encloses a first and second conductor with these conductors being electrically insulated from each other. The second conductor forms the ground. The received signal is to be picked up by an electrically conductive sheath which encloses the cable. The length of the cable can assume a rather extended length since the cable will be located in the out-of-the-way location. This means that the overall length of the cable can be greater than what could be utilized normally. It has been found empirically that a desirable length for the cable would be fifty-eight inches. The sheath of the cable is designed for picking up the FM signal. The FM signal is transmitted to the receiver through the first and second conductors.

DETAILED DESCRIPTION OF THE SHOWN EMBODIMENT

Figure 1:
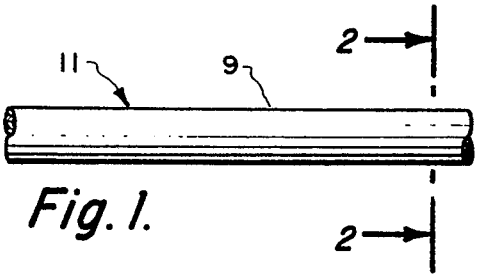
FIG. 1 is an exterior view of a portion of the cable of the antenna of the present invention.
Figure 2:
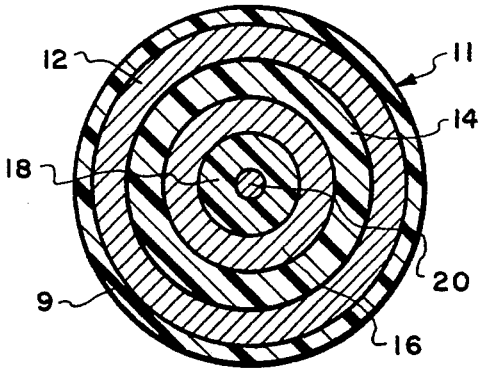
FIG. 2 is a cross-sectional view taken along line 2—2 of FIG. 1.
Figure 3:
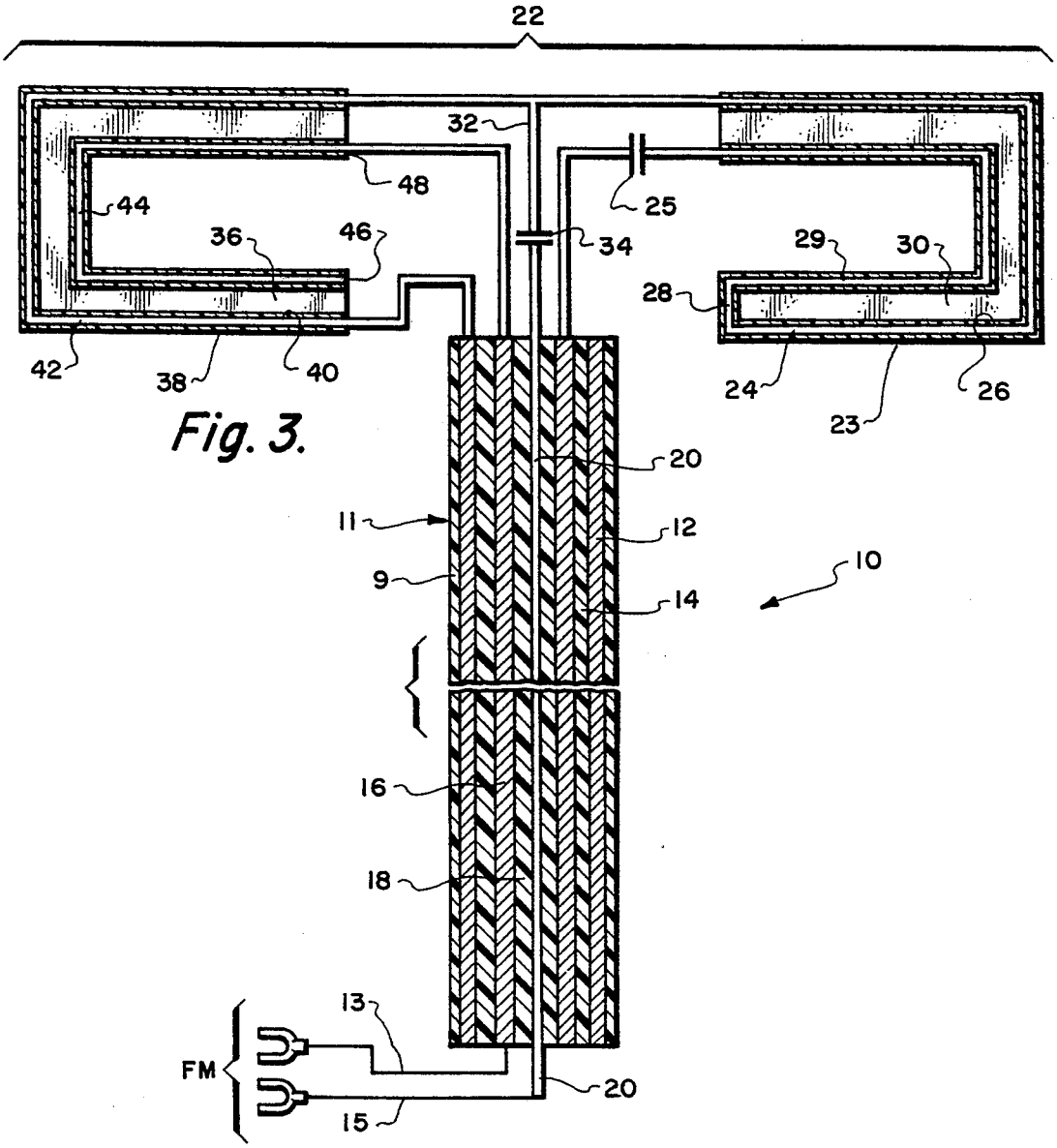
FIG. 3 is an overall electrical schematic view of the antenna of the present invention showing the cable in stretched and in cross-sectional form.

Referring particularly to the drawing, there is shown the antenna 10 of the present invention within FIG. 3. This antenna 10 includes a cable 11 which is composed in part of an antenna sheath 12 which in essence takes the form of a flexible sleeve. Interiorly and in contact with the interior surface of the sheath 12 is an electrically insulative layer 14. Layer 14 will normally take the form of either a rubber or a plastic. Interiorly of the insulative layer 14 is located a grounding conductor 16 which also is in the form of a sheath. Grounding conductor 16 will generally comprise either aluminum or copper. Both sheaths 12 and 16 will generally be in the form of a braided sleeve. Interiorly of the grounding conductor 16 is located another electrically insulated layer 18 which can be composed of plastic or rubber. Interiorly of the layer 18 and forming the central member of the cable 11 is an electrically conductive wire 20. The cable 11 is to resemble a conventional electrical conductor, readily flexible to assume any desired stretched configuration.

It is to be noted that the overall length of the sheath 12 and the cable 11 is preselected to a desired amount. A desirable figure for the FM radio band would be approximately fifty-eight inches. This places the cable 11 at approximately one-half wavelength of the FM signal and the sheath 12 is to pick up that signal. One half wavelength would be fifty four inches. FM leads 13 and 15 are respectively electrically connected to conductors 16 and 20 with these leads 13 and 15 to be attached to appropriate connections (not shown) of a radio receiver.

The reason for the impedance matching network 22 is that the impedance of a wire rod in air of one-half wavelength is approximately one thousand ohms. The impedance of a typical radio receiver would be about seventy-five ohms which matches the impedance between conductors 16 and 20. Thus, to obtain the best power transfer between the antenna and the cable (formed by conductors 16 and 20) of the radio receiver, the impedance between the antenna and the cable must be matched or equalized. Therefore, an impedance matching network composed of a shorting stub 23 and cable 38 is required. Shorting stub 23 is actually a length of cable identical to cable 38. Shorting stub 23 is constructed of two parallel conductors 24 and 29 and is about three and one-half inches in length measured from capacitor 25 and lead 32. The free outer ends of the two conductors 24 and 29 are shorted together by connector 28. Between the two conductors .24 and 29 is a gap area 26 within which is located a dielectric insulative webbing 30. Normally, the connector 28 will be in the range of one-quarter to three eighths of an inch. Therefore, between the conductors 24 and 29 there will be produced a certain amount of capacitance and also there will be a certain amount of inductance. Conductor 24 is connected by lead 32 to capacitor 34. Capacitor 34 is connected to conductor 20. Conductor 24 is connected through conductor 25 to conductor 16.

Cable 38 is constructed of a pair of parallel conductors 42 and 44 which are physically connected together by dielectric insulative webbing 36. The webbing 36 defines gap area 40. One end of conductor 42 is connected to antenna sheath 12. The other end of conductor 42 is connected to capacitor lead 32. The end 46 of conductor 44 is open (not connected). The end 48 of conductor 44 is connected to conductor 16.

It is to be understood that the length of the conductors 24, 28, 29, 42 and 44 have been arrived at empirically and have been found to result in the desired impedance matching arrangement mimicking the typical electrical components of capacitors, resistors and inductors when used as an FM radio antenna. For example, if the antenna 10 of this invention was to be used as a television antenna, the length of the conductors 24, 28, 42 and 44 plus the length of cable 11 would have different values.

It is important to understand that the cable 11 has the same cross section throughout its entire length.

Once the antenna 10 is hooked up to the FM receiver, the cable 11 can be draped in any configuration with the impedance matching network 22 being located at whatever location is convenient for the user. The impedance matching network 22 can be located within a cabinet, on top of a cabinet, on a shelf or in any other normally hidden location.

What is claimed is:

1. An antenna for a radio comprising:

an elongated transmission cable having a first conductor and a second conductor, said cable having an inner end and an outer end, said inner end having leads facilitating connection to a receiver, said first conductor being electrically insulated from said second conductor within said cable, said cable being flexible permitting movement to enable said cable to be moved to assume any desirable configuration;

an electrically conductive sheath exteriorly covering substantially the entire length of said first and said second conductors from said inner end to said outer end, said conductive sheath being electrically insulated from said first and second conductors along the said entire length of said first and said second conductors by an insulator which is coaxial with said transmission cable, said electrically conductive sheath being attached to said insulator substantially along the entirety of the outer surface of said insulator, said electrically conductive sheath to function as an electrical conductor for the received radio signal from the air;

said first conductor, said second conductor and said electrically conductive sheath being of substantially the same length and being substantially coextensive and forming a triaxial cable as a substantially unitary assembly such that said first and second conductors, said insulator and said electrically conductive sheath move unitarily as a single unit which form a flexible unit; and an impedance matching network electrically connected to said first conductor and said second conductor and to said sheath said impedance matching network located remotely from said inner end, said impedance matching network to obtain the best power transfer between said antenna and the receiver.

2. The antenna as defined in claim 1 wherein:

said cable being of a preselected fractional length of the wavelength of the receiver signal.

3. The antenna as defined in claim 2 wherein:

said second conductor being electricly grounded.

4. The antenna as defined in claim 3 wherein the overall length of said sheath being substantially equal to one-half wavelength of the received signal.

5. The antenna as defined in claim 4 wherein:

the length of said sheath being approximately fifty-eight inches.

6. An antenna as set forth in claim 1 wherein said cable is of substantially constant diameter.

7. An antenna as set forth in claim 1 wherein said impedance matching network is located at said outer end.

8. An antenna as set forth in claim 1 wherein antenna may be stretched in any desirable configuration to be placed in out-of-the-way locations.

9. The antenna as defined in claim 6 wherein said second conductor being connected to ground.

10. The antenna as defined in claim 7 wherein said second conductor being connected to ground.

* * * * *